United States Patent [19]

Small, Jr.

[11] Patent Number: 4,615,827

[45] Date of Patent: Oct. 7, 1986

[54] METHOD FOR REDUCING BRAKE NOISE IN OIL-IMMERSED DISC BRAKES

[75] Inventor: Vernon R. Small, Jr., Rodeo, Calif.

[73] Assignee: Chevron Research Company, San Francisco, Calif.

[21] Appl. No.: 725,194

[22] Filed: Apr. 19, 1985

Related U.S. Application Data

[63] Continuation of Ser. No. 525,573, Aug. 22, 1983, abandoned, which is a continuation of Ser. No. 314,632, Oct. 26, 1981, abandoned.

[51] Int. Cl.[4] ..... C10M 1/48

[52] U.S. Cl. ..... 252/32.7 E; 252/49.6

[58] Field of Search ..... 252/32.7 E, 49.6; 188/264 B, 264 E, 264 F

[56] References Cited

U.S. PATENT DOCUMENTS

| | | | |
|---|---|---|---|
| 2,795,548 | 6/1957 | Thomas et al. | 252/49.6 |
| 2,975,135 | 3/1961 | Darling et al. | 252/49.6 |
| 2,979,459 | 4/1961 | Darling et al. | 252/49.6 |
| 2,989,467 | 6/1961 | Darling et al. | 252/49.6 |
| 2,989,468 | 6/1961 | Darling et al. | 252/49.6 |
| 3,151,077 | 9/1964 | Liao | 252/49.6 |
| 3,347,790 | 10/1967 | Meinhardt | 252/32.5 |
| 3,562,159 | 2/1971 | Mastin | 252/32.7 |
| 3,844,960 | 10/1974 | Breitigam et al. | 252/32.7 |
| 3,899,432 | 8/1975 | Rothert et al. | 252/32.7 E |
| 4,331,222 | 5/1982 | Liston et al. | 252/52 |
| 4,563,293 | 1/1986 | Small, Jr. | 252/32.7 E |

FOREIGN PATENT DOCUMENTS

| | | |
|---|---|---|
| 863689 | 3/1961 | United Kingdom . |
| 2037317 | 7/1980 | United Kingdom . |

*Primary Examiner*—William R. Dixon, Jr.
*Assistant Examiner*—Cynthia A. Prezlock
*Attorney, Agent, or Firm*—S. R. LaPaglia; R. C. Gaffney; G. F. Swiss

[57] ABSTRACT

Lubricating oils containing borated 1,2-alkane diols have been found to reduce brake noise for oil-immersed disc brakes.

3 Claims, No Drawings

METHOD FOR REDUCING BRAKE NOISE IN OIL-IMMERSED DISC BRAKES

This is a continuation of Ser. No. 525,573, filed Aug. 22, 1983, now abandoned, which is a continuation of Ser. No. 314,632, filed Oct. 26, 1981, now abandoned.

FIELD OF THE INVENTION

This invention relates to lubricating oil compositions, particularly to lubricating oil compositions useful as functional fluids in systems requiring coupling, hydraulic fluids and/or lubrication of relatively moving parts. More particularly, it is concerned with functional fluids for use in the lubrication of heavy machinery, particularly high-power-output tractors, and to the reduction of brake chatter therein.

DESCRIPTION OF THE PRIOR ART

The use of heavy machinery, such as a tractor, has increased the demand for high-performance lubricating compositions. Modern tractors have many power-assisted components, such as power steering and power brakes. Power brakes are preferably of the disc type since they have greater braking capacity. The preferred disc brakes are the wet-type brake, which are immersed in a lubricant and are therefore isolated from dirt and grime.

Such brakes suffer from at least one problem, namely, brake chatter or brake squawk. This phenomenon is a very unpleasant noise that occurs upon application of the brake. In the past, friction-modifying agents, such as dioleylhydrogen phosphite, have been added to the brake lubricating composition to reduce the chatter. Lubricating compositions containing this additive tend to suffer from very high wear rates, particularly at high temperature.

A further complication in eliminating brake chatter is the desire to use the same functional fluid, not only for the brake lubrication, but also for lubrication of other tractor parts, such as the hydraulic and mechanical power take-offs, the tractor transmission, gears and bearings, and the like. The functional fluid must act as a lubricant, a power transfer means, and as a heat transfer medium. Obtaining a compounded fluid to diol, borated octadecane-1,2-diol, borated eicosane-1,2-diol, borated tricontane-1,2-diol, and the like, but a blend of several carbon numbers is preferred. Typical blends include the borated 1,2-diols of 10 to 30 (incl.) carbon atom alkanes; the borated 1,2-diols of 12, 14, 16, 18 and 20 carbon atom alkanes; the borated 1,2-diols of 15 to 20 (incl.) carbon atom alkanes; the borated 1,2-diols of 15 to 18 (incl.) carbon atom alkanes; the borated 1,2-diols of 20 to 24 (incl.) carbon atom alkanes; the borated 1,2-diols of 24, 26 and 28 carbon atom alkanes, and the like.

The borated long-chain 1,2-alkane diols are prepared by borating a long-chain 1,2-alkane diol of the formula:

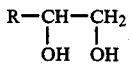

II wherein R is as defined above, with a stoichiometric amount of boric acid with removal of the water of reaction by azeotropic distillation. The reaction is believed to proceed according to the following scheme:

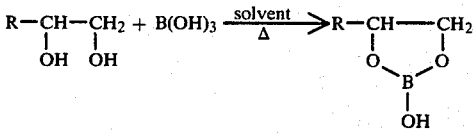

where R is alkyl containing 8 to 28 carbon atoms.

The reaction may be carried out at a temperature in the range of 60° C. to 135° C., in the presence of any suitable organic solvent such as methanol, benzene, xylenes, toluene, neutral oil and the like. If the solvent does not form an azeotrope with water, enough of an azeotropic forming agent is included to remove water azeotropically.

The diols useful for this invention are either commercially available or are readily prepared from the corresponding 1-olefin by methods well-known in the art. For example, the olefin is first reacted with peracid, such as peroxyacetic acid or hydrogen peroxide plus formic acid to form an alkane-1,2-epoxide which is readily hydrolyzed under acid or base catalysis to the alkane-1,2-diol. In another process, the olefin is first halogenated to a 1,2-dihalo-alkane and subsequently hydrolyzed to an alkane-1,2-diol by reaction first with sodium acetate and then with sodium hydroxide.

1-Olefins are available from the thermal cracking of waxes. This process produces olefins of all carbon numbers. 1-Olefins having an even number of carbon atoms are prepared by the well-known ethylene "growth" reaction. Olefins obtained by either of these processes are essentially linear in structure with little or no branching. Linear olefins are the preferred olefins for conversion into alkane-1,2-diols.

The lubricating compositions used in the process of this invention contain a major amount of a lubricating oil and from about 0.1% to 5.0% by weight of the borated 1,2-alkane diol of the Formula I, preferably from 0.5% to 2% by weight based on the weight of the total composition. The optimum amount of a borated 1,2-alkane diol within these ranges will vary slightly depending on the base oil and other additives present in the oil.

Additive concentrates are also included within the scope of this invention. In the concentrate additive form, the borated 1,2-alkane diol is present in a concentration ranging from 5% to 50% by weight.

The lubricating compositions are prepared by admixing, using conventional techniques, the appropriate amount of the desired borated 1,2-alkane diol with the lubricating oil. When concentrates are being prepared, the amount of lubricating oil is limited, but is sufficient to dissolve the required amount of borated 1,2-alkane diol. Generally, the concentrate will have sufficient borated 1,2-alkane diol to permit subsequent dilution with 1- to 10-fold more lubricating oil.

The lubricating oil, which may be employed in the practice of this invention, includes a wide variety of hydrocarbon oils derived from synthetic or natural sources, such as naphthenic base, paraffin base, and mixed base oils as are obtained from the refining of crude oil. Other lubricating oils derived from shale oil, tar sands or coal are also useful. The lubricating oils may be used individually or in combinations wherever miscible. The lubricating oils generally have a viscosity which ranges from 50 to 5,000 SUS (Saybolt Universal Seconds), and usually from 100 to 1,500 SUS at 100° F.

The preferred oils have an SAE rating in the range of 10 to 40 and are paraffinic in structure.

In some tractor systems in which the brake fluid is kept in a separate sump, the hydrocarbon oil/borated 1,2-alkane diol composition of this invention is a sufficient lubricant and can be used as such. However, in the more usual tractor systems in which there is a common sump for all functional fluids, e.g., transmission lubricant, hydraulic fluid, and the like, the lubricating oil is compounded with a variety of additives. These additives include anti-oxidants, detergents, dispersants, rust inhibitors, foam inhibitors, corrosion inhibitors, anti-wear agents, viscosity index (VI) improvers, friction control agents, elastomer swell agents, extreme pressure (EP) agents, pour point depressants, and metal deactivators. All of these additives are well-known in the lubricating oil art.

The preferred additives which may be added to the lubricating oils to which the borated 1,2-alkane diols of the Formula I are added, are the oil soluble detergents, such as the alkali or alkaline earth metal hydrocarbyl sulfonates, or alkali or alkaline earth metal phenates, or mixtures thereof, extreme pressure additives, such as the Group II metal salt dihydrocarbyl dithiophosphates and dispersants such as the alkenyl succinimides, or succinates or mixtures thereof.

The alkali or alkaline earth metal hydrocarbyl sulfonates may be either petroleum sulfonate, synthetically alkylated aromatic sulfonates, or aliphatic sulfonates such as those derived from polyisobutylene. One of the more important functions of the sulfonates is to act as a detergent and dispersant. These sulfonates are well-known in the art. The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates which are aromatic in character.

Certain sulfonates are typically prepared by sulfonating a petroleum fraction having aromatic groups, usually mono- or dialkylbenzene groups, and then forming the metal salt of the sulfonic acid material. Other feedstocks used for preparing these sulfonates include synthetically alkylated benzenes and aliphatic hydrocarbons prepared by polymerizing a mono- or diolefin, for example, a polyisobutenyl group prepared by polymerizing isobutene. The metallic salts are formed directly or by metathesis using well-known procedures.

The sulfonates may be neutral or overbased having base numbers up to about 400 or more. Carbon dioxide is the most commonly used material to produce the basic or overbased sulfonates. Mixtures of neutral and overbased sulfonates may be used. The neutral sulfonates are ordinarily used so as to provide from 5 to 25 millimoles of sulfonate per kilogram of the total composition. Preferably, the neutral sulfonates are present from 10 to 20 millimoles per kilogram of the total composition and the overbased sulfonates are present from 50 to 200 millimoles per kilogram of the total composition.

The phenates for use in this invention are those conventional products which are the alkali or alkaline earth metal salts of alkylated phenols. One of the functions of the phenates is to act as a detergent and dispersant. The phenols may be mono- or polyalkylated.

The alkyl portion of the alkylphenate is present to lend oil solubility to the phenate. The alkyl portion can be obtained from naturally occurring or synthetic sources. Naturally occurring sources include petroleum hydrocarbons such as white oil and wax. Being derived from petroleum, the hydrocarbon moiety is a mixture of different hydrocarbyl groups, the specific composition of which depends upon the particular oil stock which was used as a starting material. Suitable synthetic sources include various commercially available alkenes and alkane derivatives which, when reacted with the phenol, yield an alkylphenol. Suitable radicals obtained include butyl, hexyl, octyl, decyl, dodecyl, hexadecyl, eicosyl, tricontyl, and the like. Other suitable synthetic sources of the alkyl radical include olefin polymers such as polypropylene, polybutylene, polyisobutylene and the like.

The alkyl group can be straight-chained or branch-chained, saturated or unsaturated (if unsaturated, preferably containing not more than 2 and generally not more than 1 site of olefinic unsaturation). The alkyl radicals will generally contain from 4 to 30 carbon atoms. Generally when the phenol is monoalkyl-substituted, the alkyl radical should contain at least 8 carbon atoms. The phenate may be sulfurized if desired. It may be either neutral or overbased and if overbased will have a base number of up to 200 to 300 or more. Mixtures of neutral and overbased phenates may be used.

The phenates are ordinarily present in the oil to provide from 10 to 60 millimoles of phenate per kilogram of the total composition. Preferably, the neutral phenates are present from 20 to 50 millimoles per kilogram of the total composition and the overbased phenates are present from 50 to 200 millimoles per kilogram of the total composition. Preferred metals are calcium, magnesium, strontium or barium.

The sulfurized alkaline earth metal alkylphenates may also be used. These salts are obtained by a variety of processes such as treating the neutralization product of an alkaline earth metal base and an alkylphenol with sulfur. Conveniently the sulfur, in elemental form, is added to the neutralization product and reacted at elevated temperatures to produce the sulfurized alkaline earth metal alkylphenate.

If more alkaline earth metal base were added during the neutralization reaction than was necessary to neutralize the phenol, a basic sulfurized alkaline earth metal alkylphenate is obtained. See, for example, the process of Walker et al, U.S. Pat. No. 2,680,096. Additional basicity can be obtained by adding carbon dioxide to the basic sulfurized alkaline earth metal alkylphenate. The excess alkaline earth metal base can be added subsequent to the sulfurization step but is conveniently added at the same time as the alkaline earth metal base is added to neutralize the phenol.

Carbon dioxide is the most commonly used material to produce the basic or "overbased" phenates. A process wherein basic sulfurized alkaline earth metal alkylphenates are produced by adding carbon dioxide is shown in Hanneman, U.S. Pat. No. 3,178,368.

The Group II metal salts of dihydrocarbyl dithiophosphoric acids exhibit wear, antioxidant and thermal stability properties. Group II metal salts of phosphorodithioic acids have been described previously. See, for example, U.S. Pat. No. 3,390,080, columns 6 and 7, wherein these compounds and their preparation are described generally. Suitably, the Group II metal salts of the dihydrocarbyl dithiophosphoric acids useful in the lubricating oil composition of this invention contain from about 4 to about 12 carbon atoms in each of the hydrocarbyl radicals and may be the same or different and may be aromatic, alkyl or cycloalkyl. Preferred hydrocarbyl groups are alkyl groups containing from 4 to 8 carbon atoms and are represented by butyl, isobutyl, sec.-butyl, hexyl, isohexyl, octyl, 2-ethylhexyl and the like. The metals suitable for forming these salts include barium, calcium, strontium, zinc and cadmium, of which zinc is preferred.

Preferably, the Group II metal salt of a dihydrocarbyl dithiophosphoric acid has the following formula:

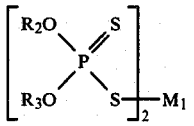

wherein:

$R_2$ and $R_3$ each independently represent hydrocarbyl radicals as described above, and $M_1$ represents a Group II metal cation as described above.

The dithiophosphoric salts are present in the lubricating oil composition in an amount effective to inhibit wear and oxidation of the lubricating oil. The preferred amount ranges from about 3 to 30 millimoles of dithiophosphoric salt per kilogram of the total composition. Most preferably the salt is present in an amount ranging from about 15 to 20 millimoles per kilogram of the total lubricating oil composition.

The alkenyl succinimide or succinate or mixtures thereof are present to, among other things, act as a dispersant and prevent formation of deposits. The alkenyl succinimides and succinates are well-known in the art. The alkenyl succinimides are the reaction product of a polyolefin polymer-substituted succinic anhydride with an amine, preferably a polyalkylene polyamine, and the alkenyl succinates are the reaction product of a polyolefin polymer-substituted succinic anhydride with monohydric and polyhydric alcohols, phenols and naphthols, preferably a polyhydric alcohol containing at least three hydroxy radicals. The polyolefin polymer-substituted succinic anhydrides are obtained by reaction of a polyolefin polymer or a derivative thereof with maleic anhydride. The succinic anhydride thus obtained is reacted with the amine or hydroxy compound. The preparation of the alkenyl succinimides has been described many times in the art. See, for example, U.S. Pat. Nos. 3,390,082, 3,219,666 and 3,172,892, the disclosure of which are incorporated herein by reference. The preparation of the alkenyl succinates has also been described in the art. See, for example, U.S. Pat. Nos. 3,381,022 and 3,522,179, the disclosures of which are incorporated by reference.

Particularly good results may be obtained with the lubricating oil compositions of this invention when the alkenyl succinimide or succinate is a polyisobutene-substituted succinic anhydride of a polyalkylene polyamine or polyhydric alcohol, respectively.

The polyisobutene from which the polyisobutene-substituted succinic anhydride is obtained by polymerizing isobutene and can vary widely in its compositions. The average number of carbon atoms can range from 30 or less to 250 or more, with a resulting number average molecular weight of about 400 or less to 3,000 or more. Preferably, the average number of carbon atoms per polyisobutene molecule will range from about 50 to about 100 with the polyisobutenes having a number average molecular weight of about 600 to about 1,500. More preferably, the average number of carbon atoms per polyisobutene molecule ranges from about 60 to about 90, and the number average molecular weight ranges from about 800 to 1,300. The polyisobutene is reacted with maleic anhydride according to well-known procedures to yield the polyisobutene-substituted succinic anhydride.

In preparing the alkenyl succinimide, the substituted succinic anhydride is reacted with a polyalkylene polyamine to yield the corresponding succinimide. Each alkylene radical of the polyalkylene polyamine usually has up to about 8 carbon atoms. The number of alkylene radicals can range up to about 8. The alkylene radical is exemplified by ethylene, propylene, butylene, trimethylene, tetramethylene, pentamethylene, hexamethylene, octamethylene, etc. The number of amino groups generally, but not necessarily, is one greater than the number of alkylene radicals present in the amine, i.e., if a polyalkylene polyamine contains 3 alkylene radicals, it will usually contain 4 amino radicals. The number of amino radicals can range up to about 9. Preferably, the alkylene radical contains from about 2 to about 4 carbon atoms and all amine groups are primary or secondary. In this case, the number of amine groups exceeds the number of alkylene groups by 1. Preferably the polyalkylene polyamine contains from 3 to 5 amine groups. Specific examples of the polyalkylene polyamines include ethylenediamine, diethylenetriamine, triethylenetetramine, propylenediamine, tripropylenetetramine, tetraethylenepentamine, trimethylenediamine, pentaethylenehexamine, di(trimethylene)triamine, tri(hexamethylene)tetramine, etc.

Other amines suitable for preparing the alkenyl succinimide useful in this invention include the cyclic amines such as piperizine, morpholine and dipiperizines.

Preferably the alkenyl succinimides which may be used in the compositions of this invention have the following formula:

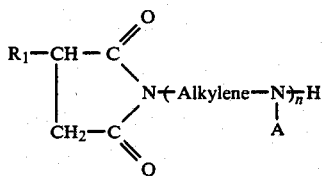

I wherein:

a. $R_1$ represents an alkenyl group, preferably a substantially saturated hydrocarbon prepared by polymerizing aliphatic monoolefins. Preferably $R_1$ is prepared from isobutene and has an average number of carbon atoms and a number average molecular weight as described above;

b. the "Alkylene" radical represents a substantially hydrocarbyl group containing up to about 8 carbon atoms and preferably containing from about 2–4 carbon atoms as described hereinabove;

c. A represents a hydrocarbyl group, an amine-substituted hydrocarbyl group, or hydrogen. The hydrocarbyl group and the amine-substituted hydrocarbyl groups are generally the alkyl and amino-substituted alkyl analogs of the alkylene radicals described above. Preferably A represents hydrogen; d. n represents an integer of from about 1 to 10, and preferably from about 3–5.

The alkenyl succinimide can be reacted with boric acid or a similar boron-containing compound to form borated dispersants having utility in this invention. The borated succinimides are intended to be included within the scope of the term "alkenyl succinimide".

The alkenyl succinates are those of the abovedescribed succinic anhydride with hydroxy compounds which may be aliphatic compounds such as monohydric and polyhydric alcohols or aromatic compounds such as phenols and naphthols. The aromatic hydroxy compounds from which the esters may be derived are illustrated by the following specific examples: phenol, beta-naphthol, alpha-naphthol, cresol, resorcinol, catehol, p,p'-dihydroxybiphenyl, 2-chlorophenol, 2,4-dibutylphenol, propene tetramer-substituted phenol, didodecylphenol, 4,4'-methylene-bisphenol, alpha-decyl-beta-naphthol, polyisobutene(molecular weight of 1000)-substituted phenol, the condensation product of heptylphenol with 0.5 mole of formaldehyde, the condensation product of octylphenol with acetone, di(hydroxyphenyl)oxide, di(hydroxyphenyl)sulfide, di(hydroxyphenyl)disulfide, and 4-cyclohexylphenol. Phenol and alkylated phenols having up to three alkyl substituents are preferred. Each of the alkyl substituents may contain 100 or more carbon atoms.

The alcohols from which the esters may be derived preferably contain up to about 40 aliphatic carbon atoms. They may be monohydric alcohols such as methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, monooleate of ethylene glycol, monostearate of diethylene glycol, secpentyl alcohol, tert-butyl alcohol, 5-bromo-dodecanol, nitro-octadecanol and dioleate of glycerol. The polyhydric alcohols preferably contain from 2 to about 10 hydroxy radicals. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene radical contains from 2 to about 8 carbon atoms. Other useful polyhydric alcohols include glycerol, monooleate of glycerol, monomethyl ether of glycerol, pentraerythritol, 9,10-dihydroxy stearic acid, methyl ester of 9,10-dihydroxy stearic acid, 1,2-butanediol, 2,3-hexanediol, 2,4-hexanediol, pinacol, erythritol, arabitol, sorbitol, mannitol, 1,2-cyclohexanediol, and xylene glycol. Carbohydrates such as sugars, starches, celluloses, etc., likewise may yield esters. The carbohydrates may be exemplified by a glucose, fructose, sucrose, rhamnose, mannose, glyceraldehyde, and galactose.

An especially preferred class of polyhydric alcohols are those having at least three hydroxy radicals, some of which have been esterified with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The esters may also be derived from unsaturated alcohols such as allyl alcohol, cinnamyl alcohol, propargyl alcohol, 1-cyclohexene-3-ol, an oleyl alcohol. Still other classes of the alcohols capable of yielding the esters of this invention comprises the ether-alcohols and aminoalcohols including, for example, the oxy-alkylene-, oxyarylene-, amino-alkylene-, and amino-arylene-substituted alcohols having one or more oxy-alkylene, amino-alkylene or amino-arylene oxy-arylene radicals. They are exemplified by Cellosolve, carbitol, phenoxyethanol, heptylphenyl-(oxypropylene)$_6$-H, octyl-(oxyethylene)$_{30}$-H, phenyl(oxyoctylene)$_2$-H, mono(heptylphenyl-oxypropylene)substituted glycerol, poly(styrene oxide), amino-ethanol, 3-amino ethyl-pentanol, di(hydroxyethyl)amine, p-aminophenol, tri(hydroxypropyl-)amine, N-hydroxyethyl ethylene diamine, N,N,N',N'-tetrahydroxytrimethylene diamine, and the like. For the most part, the ether-alcohols having up to about 150 oxy-alkylene radicals in which the alkylene radical contains from 1 to about 8 carbon atoms are preferred.

The esters may be di-esters of succinic acids or acidic esters, i.e., partially esterified succinic acids, as well as partially esterified polyhydric alcohols or phenols, i.e., esters having free alcoholic or phenolic hydroxyl radicals. Mixtures of the above-illustrated esters likewise are contemplated within the scope of the invention.

The alkenyl succinates can be reacted with boric acid or a similar boron-containing compound to form borated dispersants having utility in this invention. Such borated succinates are described in U.S. Pat. No. 3,533,945, the disclosure of which is incorporated herein by reference. The borated succinates are intended to be included within the scope of the term "alkenyl succinate."

The alkenyl succinimide and succinates are present in the lubricating oil compositions in an amount effective to act as a dispersant and prevent the deposit of contaminants formed in the oil. The amount of alkenyl succinimide and succinates can range from about 0.5 percent to about 20 percent weight of the total lubricating oil composition. Preferably the amount of alkenyl succinimide or succinate which may be present in the lubricating oil composition ranges from about 2 to about 5 percent by weight of the total composition.

The finished lubricating oil may be single or multigrade. Multigrade lubricating oils are prepared by adding viscosity index (VI) improvers. Typical viscosity index improvers are polyalkyl methacrylates, ethylene propylene copolymers, styrene diene copolymers and the like. So-called decorated VI improvers having both viscosity index and dispersant properties are also suitable for use in the formulations of this invention.

The following examples are offered to specifically illustrate the invention. These examples and illustrations are not to be construed in any way as limiting the scope of the invention.

EXAMPLE 1

A five-liter reaction flask was charged with 1050 grams (4 moles) of $C_{15-18}$ alkane 1,2-diol; 272 grams (4.4 moles) of boric acid and 1500 grams of xylene. The stirred reaction mixture was heated under reflux for 90 hours. At the end of this time 191 mls of water was collected. The reaction mixture was cooled, filtered and the solvent was removed in vacuo to afford 1158 grams of product containing 6.3% boron.

EXAMPLE 2

The compositions of this invention were tested in a laboratory test. The test was carried out on an SAE No.

2 friction machine modified by adding a moderate-speed hydraulic motor drive. The test specimen was a sandwich of one General Metals Powder Co. 1500 mix sintered bronze plate between two steel spacer plates mounted in the above apparatus. The test fluid, about 300 grams in quantity, was then charged to the test-oil sump. The hydraulic drive rotated the test specimens at 100 rpm. A piston-like brake was applied at an apply pressure of 75 psig. The SAE No. 2 load cell measured the braking torque and an electric tachometer measured rpm. An x-y plotter was used to produce a trace of torque versus rpm as the hydraulic drive was slowly adjusted to decrease the speed to 0 rpm. The brake chatter performance of a fluid is related to the slope of the friction vs. velocity curve. The slope of the curve is found by measuring the slope of a line drawn through the 50 rpm point on the trace and the highest point on the trace below 50 rpm. As the slope of this curve becomes increasingly negative, the brake chatter noise becomes progressively louder. This tendency correlates with full scale tractor brake noise tests.

The above described test was run on three mineral oil based tractor hydraulic fluids. The results for these three fluids are shown in Table I. Composition A was a base without a friction modifier and composition B contains in addition 1% borated alkanediol of Example 1. Composition C is a commercial tractor hydraulic fluid. As shown in Table I, the addition of borated 1,2-alkanediol (Fluid B) to the base fluid (Fluid A) increased the slope indicating it is effective in reducing brake chatter. Also shown in Table 1 is the slope obtained with a commercial tractor hydraulic fluid.

TABLE I

Effect of Borated 1,2-Alkanediol Upon Laboratory Brake Chatter Simulation

| Formulation | Slope of Friction v. Velocity Curve |
|---|---|
| A base oil | −.0131 |
| B base oil + 1% by weight Borated 1,2-alkanediol of Example 1 | −.0086 |
| C Commercial Formulation | −.0143 |

I claim:

1. A method for reducing oil-immersed disc brake chatter by lubricating the contacting surfaces of oil-immersed disc brakes with a composition comprising a lubricating oil containing from about 0.1% to about 5% by weight of a borated 1,2-alkane diol of the formula:

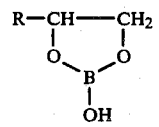

wherein R is alkyl containing from 8 to 28 carbon atoms or mixtures thereof.

2. The method of claim 1 wherein R is alkyl containing 8 to 18 carbon atoms.

3. The method of claim 2 wherein the borated 1,2-alkane diol is a mixture of borated 1,2-diols containing from 15 to 18 carbon atoms.

* * * * *